United States Patent [19]

Nielsen et al.

[11] Patent Number: 4,462,023

[45] Date of Patent: Jul. 24, 1984

[54] PERSONAL PROPERTY ALARM

[75] Inventors: Chris E. Nielsen, 22 Almaden Ct., San Francisco, Calif. 94118; Donald D. Conard, San Anselmo, Calif.

[73] Assignee: Chris E. Nielsen, San Francisco, Calif.

[21] Appl. No.: 339,918

[22] Filed: Jan. 18, 1982

[51] Int. Cl.[3] ..... G08B 13/02

[52] U.S. Cl. ..... 340/571; 340/689; 340/693

[58] Field of Search ..... 340/571, 689, 693

[56] References Cited

U.S. PATENT DOCUMENTS 3,248,723 4/1966 Miethe ..... 340/689

3,644,921 2/1972 Duggan et al. ..... 340/689

*Primary Examiner*—Glen R. Swann, III

*Attorney, Agent, or Firm*—Townsend and Townsend

[57] ABSTRACT

A position sensitive alarm is mounted to an item of personal property to be protected so that if the property is moved, an audible alarm is produced. The alarm includes a housing in which a battery, a buzzer and a position-sensitive switch are mounted therein. An aperture is cut in the housing so that the sound produced by the buzzer is not muffled within the housing. The components within the housing are fully enclosed, except for the battery. The battery is mounted within an open sided battery case, which itself is mounted within the housing. The circuit, lacking an on/off switch, is disarmed and armed by removal and replacement of the battery in the battery case.

4 Claims, 5 Drawing Figures

PERSONAL PROPERTY ALARM

FIELD OF THE INVENTION

This invention relates to alarms, particularly a position-sensitive alarm for protection of an item of personal property.

BACKGROUND OF THE INVENTION

Ever since it became apparent that one must protect either his or her person, property or land from others, a multitude of alarms and alarm systems have been developed. Alarms for protection of personal property from theft, for example in such places as museums or retail stores, have generally included some sort of plunger for sensing the removal of the object. See, for example, U.S. Pat. No. 4,274,088. A problem with this type of alarm is that if a thief knows about the plunger mechanism he can easily deactivate the alarm by keeping the plunger depressed while and after removing the object.

Position sensitive switches have been used in alarms intended to protect the person. However, these alarm systems have generally been relatively complicated and expensive, as well as bulky, and thus not particularly suited for use in protecting numerous individual items of personal property.

What has been lacking in the prior art is a position-sensitive alarm system which is small, inexpensive to produce and resists disablement by a thief.

SUMMARY OF THE INVENTION

A position sensitive alarm is mounted to an item of personal property to be protected so that if the property is moved, an audible alarm signal is produced. The alarm includes a housing in which three electrical elements, namely a battery, a buzzer and a position-sensitive switch, are mounted. The electrical elements are connected in a series loop.

An aperture is cut in the housing so that the second produced by the buzzer is not muffled within the housing. The components within the housing are preferably fully enclosed by the housing, except for a portion of the buzzer and the battery. The battery is preferably mounted within a five-sided battery case which itself is mounted within the housing. The circuit, lacking an on/off switch, is disarmed and armed by the removal of the battery from and the replacement of the battery into the battery case.

A primary advantage of the present invention is that it is small and includes only three electrical elements so it is inexpensive to produce; it is therefore suitable for use by attachment to numerous individual items of personal property to protect them against theft by sounding an audible alarm signal when moved.

A significant feature of the invention is that it provides ready access to the battery within the battery case so that the alarm can be disabled by removal of the battery. This eliminates the need for an on/off switch thus keeping the size small and cost low. By mounting the alarm with the open battery case facing the protected object, the alarm cannot be disabled except by first physically removing the alarm from the protected object. However, in so doing the position sensitive switch is activated so that the buzzer produces its audible alarm signal.

Other features and advantages of the present invention will appear from the following description in which the preferred embodiment has been set forth in detail in conjunction with the accompanying drawing.

DETAILED DESCRIPTION OF THE PREFERRED EMBODIMENTS

Figures 1, 2, 3, 4, 5:
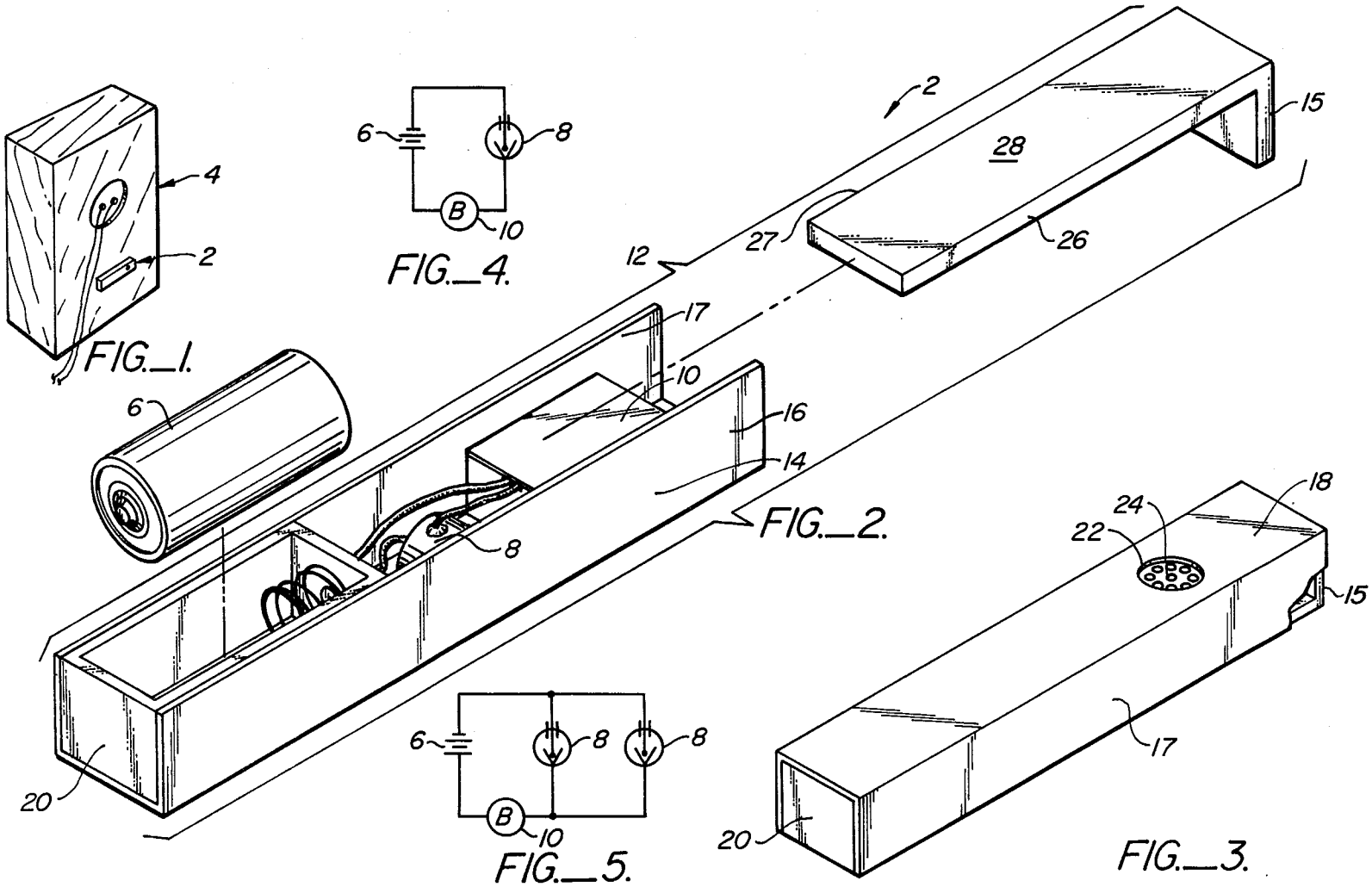
FIG. 1 shows the position-sensitive alarm of the present invention mounted to a speaker enclosure.
FIG. 2 is an exploded isometric view of the position-sensitive alarm of the present invention.
FIG. 3 is an isometric view of the alarm of FIG. 2 showing the top of the case.
FIG. 4 is a schematic of the circuit of the alarm of FIG. 2.
FIG. 5 is a schematic of the circuit of an alternative embodiment of the alarm of FIG. 2.

Referring now to the figures, the position-sensitive alarm 2 of the present invention is shown mounted to the rear of a speaker enclosure 4. Alarm 2 includes a battery 6, a position-sensitive switch 8 and a buzzer 10 mounted within a housing 12. Battery 6, switch 8 and buzzer 10 are electrically connected in a series loop as shown in FIG. 4.

Housing 12 includes a channel shaped case 14 having a cover 15, parallel sides 16, 17 and a top 18. A conventional five-sided battery enclosure 20 is mounted within one end of case 14 so that battery 6 can be removed and replaced at will by the user. Top 18 includes an aperture 22 against which a speaker element 24 of buzzer 10 is mounted. This allows the sound produced by buzzer 10 to readily escape from within housing 12. Switch 8 is a conventional position sensitive switch, such as those made by Fifth Dimension of Trenton, N.J., as Part No. TS7K or by Durakool, Inc. of Elkhart, Ind., as Part No. A½N, and is mounted to case 14 at a suitable attitude. The attitude chosen will depend upon the attitude at which alarm 2 will be mounted to the item to be protected, in this case speaker enclosure 4, so that when enclosure is upright, switch 8 remains open.

Cover 15 is mounted to case 14 and covers the portion of the interior of case 14 not taken up by battery enclosure 20. Edges 26, 27 of cover 15 lie between sides 16, 17 and are secured therebetween typically by the use of an adhesive.

Standard position-sensitive switches have a range of orientations over which they remain open. In certain circumstances this range may be too large so the sensitivity of the alarm is not as great as desired. Therefore it has been found that by placing two switches 8, as shown in FIG. 5, in parallel and mounting them at slightly offset angles to one another, a quite narrowly defined range of orientations over which both of the switches remain open can be achieved. Alarm 2 can thus be made very sensitive using relatively inexpensive position-sensitive switches.

In use the user first prepares the personal property to be protected so that alarm 2 can be mounted to the property. The choice of mounting means is determined in large part by the type of property to be protected. In the disclosed embodiment alarm 2 is bonded to the rear of speaker 4. Battery 6 is inserted within battery enclosure 20 and alarm 2 is mounted to speaker enclosure 4 with outer surface 28 adhering to the speaker enclosure to prohibit access to battery 6. In mounting alarm 2 to speaker 4, the alarm is positioned so that when the speaker is resting in its normal upright attitude, switch 8 remains open so that buzzer 10 does not sound. Of course while the user is mounting alarm 2 to enclosure 4 the alarm will sound. However, by proper preparation the length of time between inserting the battery within battery enclosure 20 and mounting alarm 2 to the property can be minimized so that buzzer 10 produces its audible alarm for a relatively short period of time.

Switch 8 is constructed to be sensitive to the angle at which it is supported. Therefore, the alarm will sound unless the thief knows about the alarm and takes extraordinary care to ensure that the speaker enclosure does not tilt while being moved. If desired position-sensitive switch 8 may be of a type which is sensitive to acceleration or to both angular orientation and acceleration instead of angular orientation only. In either case the switch will be sensitive to its displacement from a neutral, stationary condition.

Modification and variation can be made to the disclosed embodiment without departing from the subject of the invention as defined in the following claims. For example, a removable cap can be used to cover battery enclosure 20 if desired.

I claim:

1. A theft protection system for use in combination with a movable article to be protected, the system comprising:

a position-sensitive alarm comprising:

a housing;

a battery having first and second terminals;

a battery enclosure, mounted within said housing, having one open side for removably mounting said battery therein;

a movement-sensitive switch means mounted within said housing and having input and output terminals electrically connected only when said switch means is displaced at least a predetermined amount from a neutral condition, said input terminal electrically connected to said first terminal;

buzzer means for producing an audible alarm signal mounted within said housing and electrically connected between said second terminal and said output terminal; and said housing including an elongate channel shaped case sized for housing said battery enclosure therein at one end and an L-shaped cover means for enclosing said switch and buzzer means within a volume defined by the other end of said case, an end of said battery enclosure and said L-shaped cover means; and means for mounting said alarm to said article so that said switch is normally open when said article is in a chosen position.

2. The system of claim 1 wherein said housing has an aperture formed therein and said buzzer means is mounted adjacent said aperture so that projection of said audible alarm signal is enhanced.

3. The system of claim 1 wherein said neutral condition is a chosen angular attitude and said predetermined amount is a chosen angular amount.

4. The system of claim 1 wherein said switch means includes a plurality of position sensitive switches connected in parallel and mounted at differing orientations whereby the sensitivity of said alarm is increased.

* * * * *